US006153019A

United States Patent [19]

Espenhahn et al.

[11] Patent Number: 6,153,019

[45] Date of Patent: Nov. 28, 2000

[54] PROCESS FOR PRODUCING A GRAIN-ORIENTATED ELECTRICAL STEEL SHEET

[75] Inventors: Manfred Espenhahn, Essen; Andreas Böttcher, Duisburg; Klaus Günther, Voerde, all of Germany

[73] Assignee: Thyssen Stahl AG, Duisburg, Germany

[21] Appl. No.: 09/171,709

[22] PCT Filed: Jul. 3, 1997

[86] PCT No.: PCT/EP97/03510

§ 371 Date: Oct. 26, 1998

§ 102(e) Date: Oct. 26, 1998

[87] PCT Pub. No.: WO98/02591

PCT Pub. Date: Jan. 22, 1998

[30] Foreign Application Priority Data

Jul. 12, 1996 [DE] Germany ..... 196 28 136

[51] Int. Cl.[7] ..... C21D 8/12

[52] U.S. Cl. ..... 148/111; 148/112; 148/113

[58] Field of Search ..... 148/111, 112, 148/113

[56] References Cited

FOREIGN PATENT DOCUMENTS

| | | | |
|---|---|---|---|
| 0 125 653 A1 | 11/1984 | European Pat. Off. . | |
| 0 307 905 A2 | 3/1989 | European Pat. Off. . | |
| 0391335 | 10/1990 | European Pat. Off. | 148/111 |
| 0398114 | 11/1990 | European Pat. Off. | 148/111 |
| 43 11 151 C1 | 7/1994 | European Pat. Off. . | |
| 0 709 470 A1 | 5/1995 | European Pat. Off. . | |
| 0 732 413 A1 | 9/1996 | European Pat. Off. . | |
| 196 28 136 C1 | 4/1997 | Germany . | |

*Primary Examiner*—Deborah Yee
*Attorney, Agent, or Firm*—Proskauer Rose LLP

[57] ABSTRACT

A process for producing a grain-oriented magnetic steel sheet in which a slab, made from a steel containing (in mass %) more than 0.005 to 0.10% C, 2.5 to 4.5% Si, 0.03 to 0.15% Mn, more than 0.01 to 0.05% S, 0.01 to 0.035% Al, 0.0045 to 0.012% N, 0.02 to 0.3% Cu, the remainder being Fe, including unavoidable impurities, is heated through and hot rolled to a final thickness between 1.5 and 7.0 mm. The hot strip is annealed and immediately cooled and cold rolled in one or several cold-rolling steps to the final thickness of the cold strip. The cold strip is subjected to a recrystallizing annealing process in a humid atmosphere containing hydrogen and nitrogen, with synchronous decarburization. A non-stick layer, essentially containing MgO, is applied to the surface of the decarburized cold strip which is then subjected to final annealing. The cold strip is then rolled into coils.

5 Claims, 5 Drawing Sheets

PROCESS FOR PRODUCING A GRAIN-ORIENTATED ELECTRICAL STEEL SHEET

This application is a 371 of PCT/EP97/03510 filed Jul. 3, 1997.

BACKGROUND OF THE INVENTION

The invention relates to a process for producing grain-oriented magnetic steel sheeting in which a slab made from a steel containing (in mass %) more than 0.005 to 0.10% C, 2.5 to 4.5% Si, 0.03 to 0.15% Mn, more than 0.01 to 0.05% S, 0.01 to 0.035% Al, 0.0045 to 0.012% N. 0.02 to 0.3% Cu, the remainder being Fe, including unavoidable impurities, is heated through at a temperature below the solubility temperature for manganese sulphides, at any rate however below 1320° C. but above the solubility temperature for copper sulphides; subsequently hot rolled to a final thickness of the hot strip between 1.5 and 7.0 mm, with an initial temperature of at least 960° C. and with a final temperature in the range of 880 to 1000° C. The hot strip is subsequently annealed for 100 to 600 s at a temperature ranging from 880 to 1150° C. and immediately cooled at a cooling rate in excess of 15 K/s and cold rolled in one or several cold-rolling steps to the final thickness of the cold strip. Subsequently the cold strip is subjected to a recrystallising annealing process in a humid atmosphere containing hydrogen and nitrogen, with synchronous decarburisation, and after application on both sides of a parting agent essentially containing MgO it is annealed at high temperature and after application of an insulating layer it is subjected to final annealing.

Such a process has been disclosed in DE 43 11 151 C1. A reduction in the preheat temperature of the slab to below the solubility temperature of MnS, at any rate however below 1320° C. is possible by using copper sulphide as the significant grain growth inhibitor. Its solubility temperature is so low that even with preheating at this reduced temperature and the subsequent hot-rolling in conjunction with annealing the hot-rolled strip, an adequate formation of this inhibitor phase is possible. Due to its very much higher solubility temperature, MnS does not play a role as an inhibitor, and AlN—whose solubility and elimination properties are in between those of Mn sulphide and Cu sulphide—participates only insignificantly in the inhibition.

The purpose of reducing the temperature prior to hot rolling is to avoid liquid slag deposits on the slabs, thus reducing wear and tear of the annealing plant and increasing production yield.

EP-B-0219 611 describes a process which also allows a reduction in the slab preheating temperature in an advantageous way. In this, (Al, Si) N-particles are used as grain growth inhibitors which are introduced by way of a nitration process to the strip which has been cold-rolled to finished thickness and decarburised. As a measure for carrying out this nitration process, the annealing atmosphere during coarse grain annealing is selected in such a way that it has a nitration ability, or else nitrating additives are used for annealing separation, or a combination of both, is disclosed.

EP-B-0 321 695 describes a similar process. Exclusively (Al, Si) N-particles are used as grain growth inhibitors. Additional details regarding the chemical composition are disclosed and a further possibility of a nitration treatment in conjunction with the decarburisation annealing is shown. Furthermore, it is indicated that the slab preheat temperatures should preferably be kept below 1200° C.

EP-B-0 339 474 also describes a process whereby however nitration treatment in the form of continuous annealing in the temperature range of 500 to 900° C. in the presence of an adequate quantity of $NH_3$ in the annealing gas is carried out in detail. Furthermore, there is a detailed description as to how the annealing nitration treatment can directly follow the decarburisation annealing. Here too, the aim is to form (Al, Si) N-particles as effective grain growth inhibitors. In this it is emphasised in particular that for such a nitration treatment, at least 100 ppm, preferably however more than 180 ppm of nitrogen must be charged. The slab pre-heat temperature should be below 1200° C.

EP-B-0 390 140 particularly emphasises the special significance of the grain size distribution of the decarburised cold strip and provides various methods for their determination. In each case, a slab preheating temperature of less than 1280° C. is stated. However, there is always the recommendation to preheat the slabs to below 1200° C.; all examples of the process indicate 1150° C. as the preheat temperature.

In comparison, the process known from DE 43 11 151 C1 has the significant advantage that the preheating temperatures do not have to be selected as low as the above-mentioned 1150 to 1200° C. With the often used mixed rolling operation of a modern hot rolling plant, slab preheating temperatures of between 1250 and 1300° C. are often set, because from the point of view of power engineering and hot-rolling technology, this temperature range is particularly favourable. In addition, the use of copper sulphide as an inhibitor has the decisive advantage that one does not have to carry out and master a nitration treatment by an additional technology, but can directly generate the grain growth inhibitor already at the beginning of the production process. In this way, further processing of the hot strip through to the finished product is significantly simplified.

SUMMARY OF THE INVENTION

The hot-rolled strip is subjected to annealing in order to eliminate the copper sulphide particles which are to form the inhibitor phase. Then follows cold rolling to the thickness of the finished strip. As an alternative to this, the hot-rolled strip can be subjected to a first cold-rolling step before the inhibitor-eliminating annealing and the last cold rolling, to the thickness of the finished strip, are carried out. This strip is finally subjected to a continuous decarburisation annealing treatment in a humid annealing atmosphere containing hydrogen and nitrogen. At the beginning of this annealing treatment, the microstructure is recrystallised and the strip is decarburised. Subsequently, a non-stick layer, essentially containing MgO, is applied to the surface of the decarburised cold strip and the strip is rolled into coils.

The decarburised cold-strip coils produced in this way are then subjected to high-temperature annealing in a hood-type furnace in order to initiate formation of the Goss texture by way of the process of secondary recrystallisation. Usually the coils are slowly heated at a heating rate of approx. 10 to 30 K/h in an annealing atmosphere comprising hydrogen and nitrogen. At a strip temperature of approx. 400° C., the dew point of the annealing gas rapidly rises because at this stage the crystal water of the non-stick layer that was applied (which essentially comprises MgO) is released. Secondary recrystallisation takes place at approximately 950 to 1020° C. While thus Goss texture formation has already been completed, nevertheless the temperature continues to be increased up to at least 1150° C., preferably to at least 1180° C., and this temperature is held for at least 2 to 20 h. This is necessary in order to clean the strip of the inhibitor particles which are no longer used, because these would otherwise remain in the material and would impede the process of magnetic reversal in the finished product. In order to ensure an optimal cleaning process, upon completion of secondary recrystallisation, usually from the beginning of the holding phase, the hydrogen content in the annealing atmosphere is heavily increased, e.g. to 100%.

During the heating phase of coarse-grain annealing, generally a mixture of hydrogen and nitrogen is used as an annealing gas, whereby above all a mixture of 75% hydrogen and 25% nitrogen is normally used. With this gas composition, a certain increase in the nitrogen content of the strip is achieved, because this stoichiometric composition contains a sufficient number of $NH_3$ molecules which are necessary for nitrogenisation. In this way the known inhibition, based on AlN is still further increased.

During the process disclosed in DE 43 11 151 C1, in which the inhibition is not based on AIN particles but on copper sulphide, when applying this type of coarse-grain annealing, occasionally, dispersions during the process of texture formation (secondary recrystallisation) can occur during high-temperature annealing. These dispersions have a direct, unfavourable effect on the magnetic values. It is thus the object of the invention to significantly reduce these dispersions during coarse-grain annealing, and in this way stabilise the progress of secondary recrystallisation whereby the magnetic values are brought to a very good level.

DETAILED DESCRIPTION OF THE PREFERRED EMBODIMENT

Figure 1:
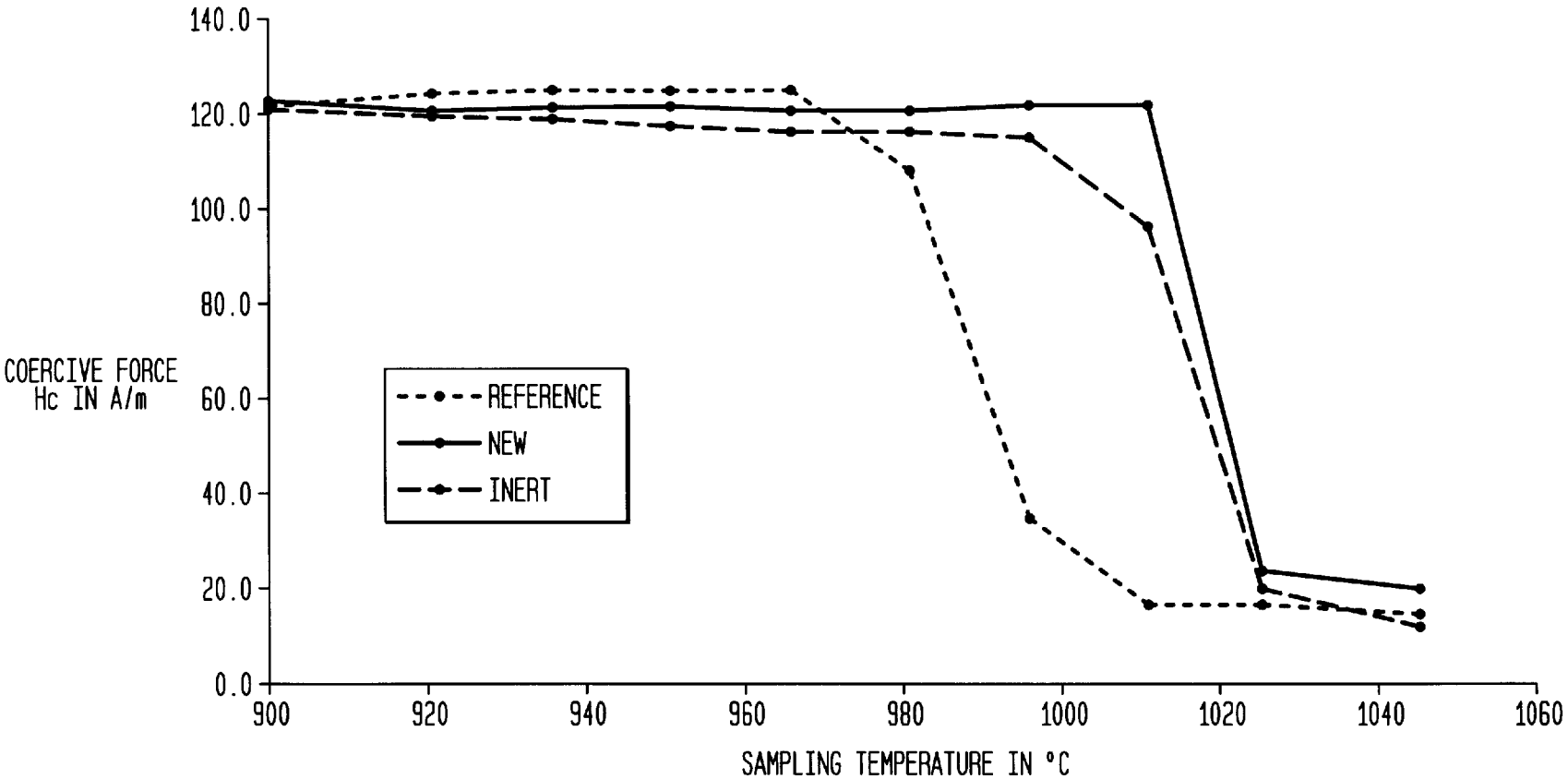
FIG. 1 graphically illustrates the coercive field strength of decarburised cold-strip samples comparing the prior art with the process according to the present invention.

In order to meet this object, the generic process according to the invention provides for the cold strip—for high-temperature annealing—to be heated in an atmosphere comprising less than 25 vol. % $H_2$, the remainder being nitrogen and/or noble gas such as argon, at least until the holding temperature is reached. After reaching the holding temperature, the $H_2$ content can be gradually increased to up to 100%.

In order to be able to evaluate and compare the progress of secondary recrystallisation, a number of identically-decarburised cold-strip samples were subjected to a laboratory simulation of high-temperature annealing in a hood-type furnace, under operational conditions. As soon as certain, previously determined, temperatures were reached during heating, individual samples were taken from this stack. In these samples, substates of materials in this phase of coarse-grain annealing were frozen. The range between 900 and 1045° C. was selected as the temperature interval because secondary recrystallisation takes place in this range. For all samples, the coercive field strength was determined and in FIG. 1 graphically entered against the sampling temperature. The coercive field strength is inversely proportional to the average grain size of the microstructure. Accordingly, the beginning of secondary recrystallisation can be recognised as a sudden drop in the coercive field strength at a certain sampling temperature. This sudden drop indicating the beginning of secondary recrystallisation can be seen in FIG. 1. This type of test is called a "recrystallisation test" (cf. M. Hastenrath et al., Anales de Fisika B, vol. 86 (1990) pp. 229–231). At the same time, nitrogen and sulphur contents were determined from these recrystallisation test samples. These investigations showed that decarburised cold strip produced according to DE 43 11 151, too, is highly nitrogenised if it is annealed in the customary coarse-grain annealing process containing 75% hydrogen and 25% nitrogen in the heating phase. At the same time however, the sulphur content significantly decreases during this coarse-grain annealing. However, this signifies a weakening of the inhibition due to the effect of copper sulphides. This desulphurisation also takes place in an inhomogenous manner which explains the dispersions of the magnetic values that were observed. But if coarse-grain annealing is changed according to the invention and the hydrogen content during heating up is limited to a maximum of 25 vol. %, then only a very much reduced desulphurisation takes place. The sulphur content is perceptibly reduced only during elevated temperatures, when secondary recrystallisation is already completed. This fact is demonstrated below by means of some examples.

The application of low hydrogen contents during the heating phase does however also significantly increase the oxidation potential of the annealing atmosphere which in individual cases can have an unfavourable effect on the subsequent formation of the insulating phosphate layer and its adhesion. However, his problem is perceptible only at the beginning of the heating phase when the dew point of the annealing gas clearly rises as a result of the release of water vapour from the non-stick layer. But at such low temperatures, no change of the inhibitor phase as a result of desulphurisation is yet evident; this only occurs at elevated temperatures. In order to avoid any unfavourable influence on the surface condition, the gas composition during the heating-up phase should be changed. It is thus favourable to commence coarse-grain annealing with an annealing atmosphere with a high hydrogen content, and under these conditions to heat to a temperature of 450 to 750° C. Then, the annealing atmosphere should be changed and a low hydrogen content, e.g. 5 to 10 vol. % should be set and heating should be continued to the holding stage. From commencement of the holding phase, the hydrogen content is then increased to 100% in the customary manner.

The examples demonstrate the effect of the measures according to the invention. Hot strips from melting charges with the chemical compositions according to Table 1 were subjected to further processing into decarburised cold strip according to the process described in DE 43 11 151 C1. This decarburised cold strip was divided and during operational trials subjected to three different coarse-grain annealing treatments.

"Reference" variant: The first variant, designated "reference" variant, was according to prior art and included an atmosphere of 75 vol. % $H_2$+25 vol. % $N_2$ in the heating phase. Heating was from ambient temperature at a rate of 15 K/h to a holding temperature of 1200° C.; this temperature was held for 20 h and subsequently slow cooling was initiated. From commencement of the holding period, the atmosphere was changed to 100% $H_2$.

"New" variant: The second coarse-grain annealing, designated "new", represented the measure according to the invention and, in contrast to "reference" included an atmosphere of 10 vol. % $H_2$+90 vol. % $N_2$ in the heating phase.

"Inert" variant: The third coarse-grain annealing, designated "inert", also represented the measure according to the invention, however, in contrast to "new" instead of $N_2$, the inert gas argon was used in the heating phase.

Figure 2A:
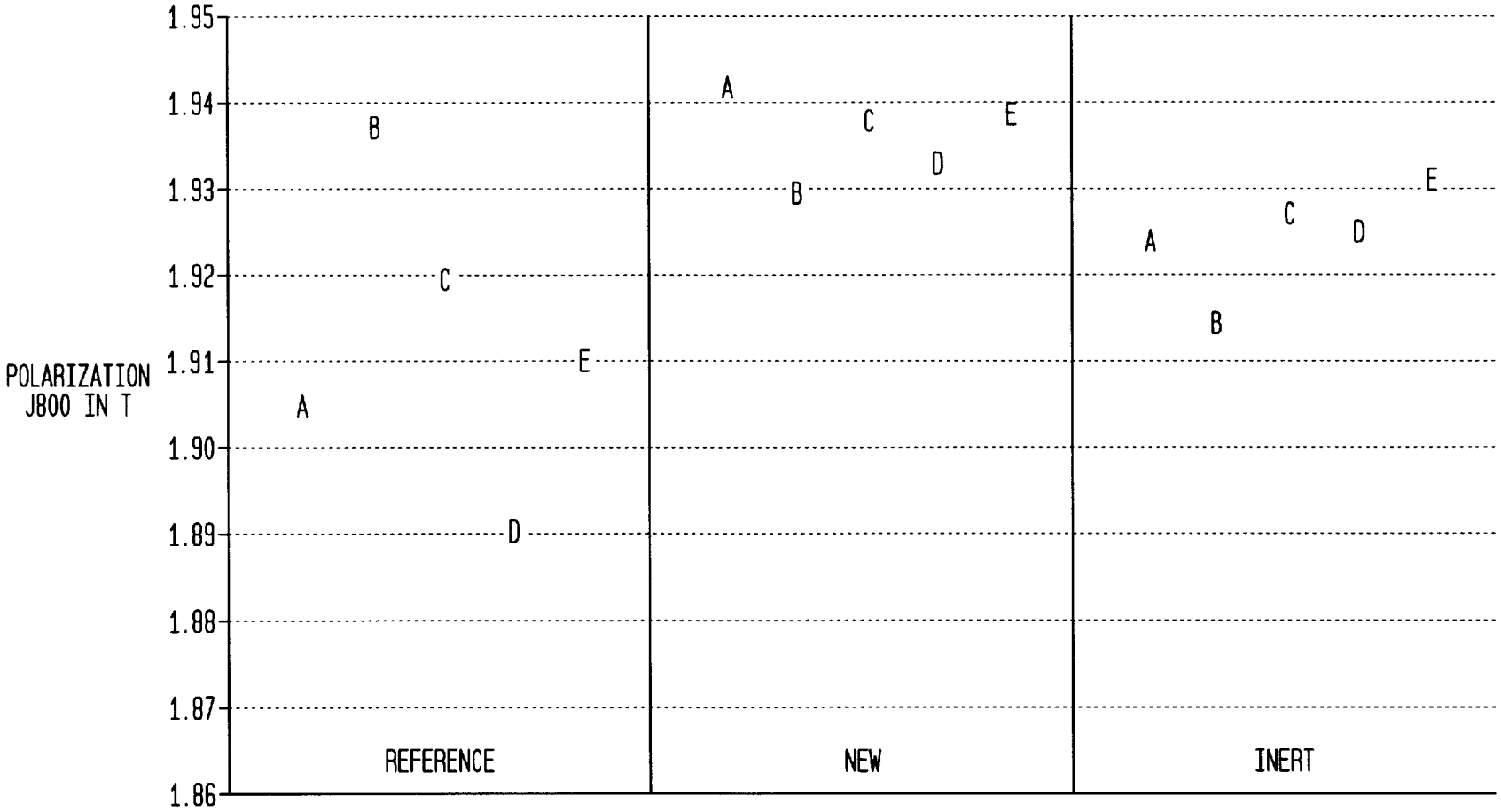
FIGS. 2A and 2B graphically illustrate of the magnetic characteristics of the strips as listed in Table 2, in accordance with the present invention.
Figure 2B:
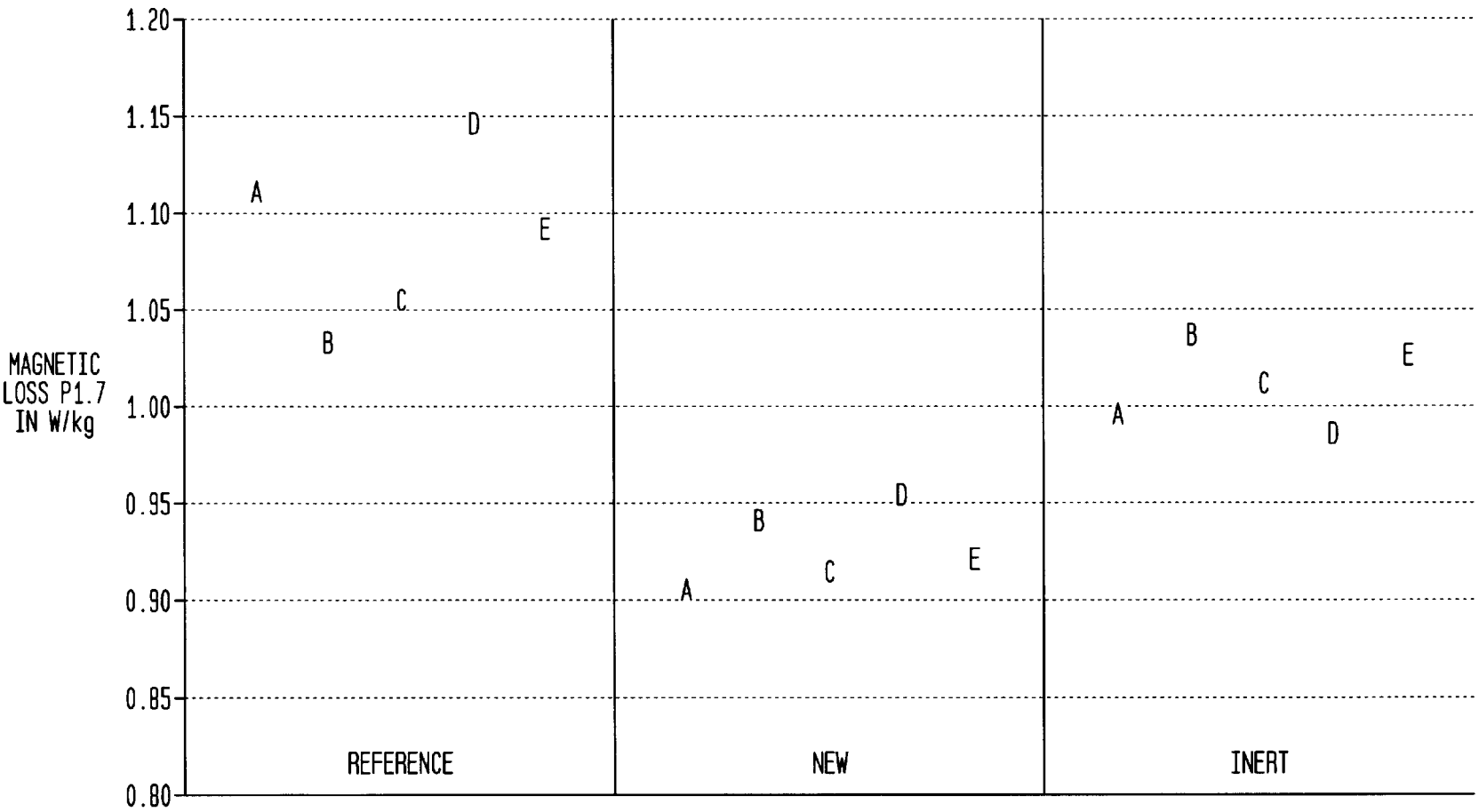

In this, the magnetic characteristics compiled in Table 2 were achieved. These values are shown graphically in FIGS. 2*a* and 2*b*. When compared to the "reference" coarse-grain annealing (prior art), the coarse-grain annealing variants "new" and "inert" according to the invention show significantly more unified magnetic values, represented by the polarisation, thus showing the stabilising effect. In addition, these values are at a high level. A comparison of the two variants according to the invention, "new" and "inert" shows that nitrogen is the most suitable as the main component of the annealing gas. For cost reasons, the use of an inert gas such as argon does not make sense. But the "inert" variant also shows an improvement and stabilisation of the magnetic properties, thus proving that it is not nitrogen as the main component of the annealing atmosphere, but the small hydrogen content, that is decisive for this.

Prior to carrying out coarse-grain annealing, samples of decarburised recrystallisation tests of the kind described above were carried out. Here, too, three variants were formed with the respective gas atmospheres in the heating-up phase as in the experiments described above.

FIG. 1, depicting the steep drops in coercive field strength, shows that in all three cases secondary recrystallisation took place. The individual recrystallisation test samples were chemically analysed to determine their nitrogen and sulphur content.

Figure 3:
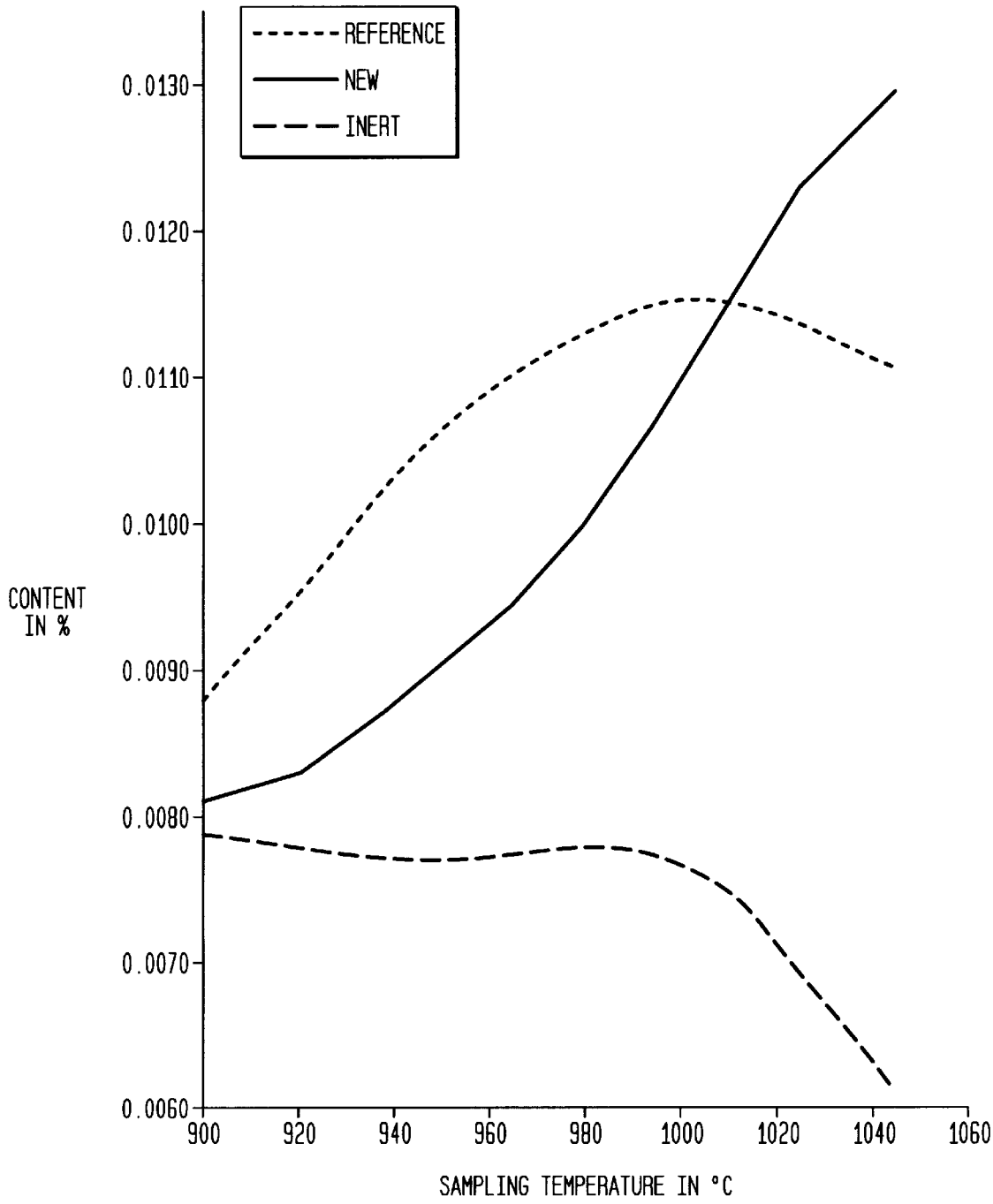
FIG. 3 graphically illustrates the development of nitrogen content during the heating phase of coarse-grain annealing, comparing the prior art with the process according to the present invention.
Figure 4:
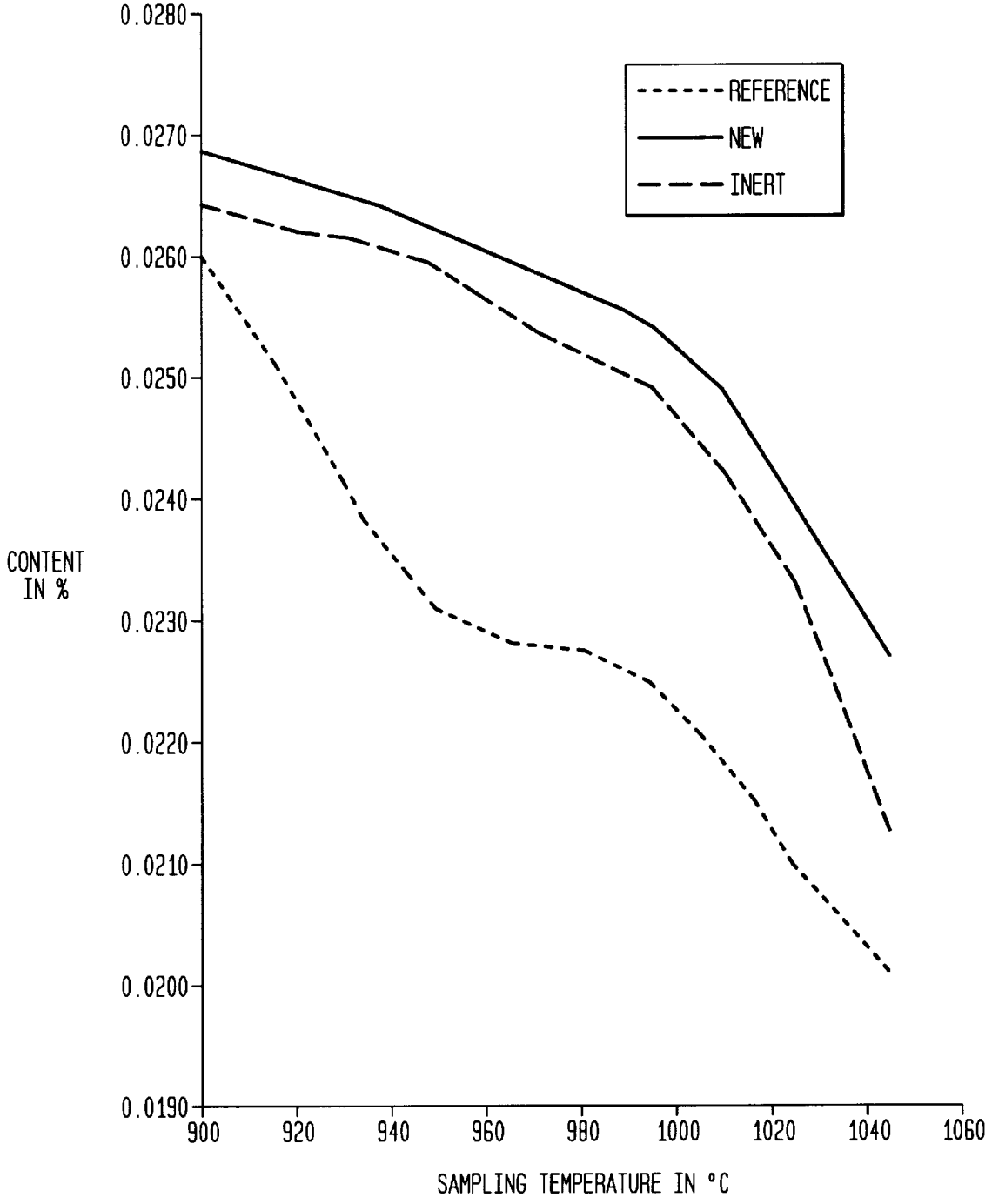
FIG. 4 graphically illustrates the development of sulphur content during the heating phase of coarse-grain annealing, comparing the prior art with the process according to the present invention.

FIG. 3 shows the development of nitrogen content and FIG. 4 shows the development of the sulphur content in the temperature interval from 900° C. to 1045° C. during the heating phase of coarse-grain annealing. For both figures, average measuring values of all strips of the melting charges A to E listed in Table 1 were calculated. The strips were rolled to a finished thickness of 0.30 mm.

In the case of the "reference" variant, the development of nitrogen content during the heating phase in FIG. 3 shows the expected high increase already at temperatures below 1020° C. By comparison, the increase in the "new" variant according to the invention is significantly less pronounced and becomes dominant only at elevated temperatures, after secondary recrystallisation has already been completed. In the case of the "inert" variant, also according to the invention, no increase in the nitrogen content takes place at all because the annealing gas does not contain nitrogen. However, a noticeable decrease in the nitrogen content only occurs at elevated temperatures above secondary recrystallisation. The effect of the two coarse-grain variants according to the invention on the development of the nitrogen content during annealing thus differs. However, the effect on the magnetic properties is roughly the same. Thus the influence on the nitrogen content in the case of material produced according to the process disclosed in DE 43 11 151 C1 cannot be the reason for the improvements which are the essence of the invention.

However, if one examines the development of the sulphur content during heating and compares the three variants examined, then the effective mechanism of the process according to the invention is easily recognised: while in the case of the "reference" variant the sulphur content drops quite quickly—even before commencement of secondary recrystallisation—such a drop is significantly less pronounced in the "new" and "inert" variants according to the invention. A reduction in the sulphur content can be explained only by a corresponding reduction in the copper sulphides acting as inhibitors. In the case of the "reference" coarse-grain annealing variant, this drop takes place quite rapidly, whereby the inhibition effect subsides early and therefore the texture selection process at the beginning of secondary recrystallisation is subjected to certain dispersions. By applying a variant according to the invention, the effect of the inhibitor phase is extended in time, with an accordingly favourable effect on the selection process during secondary recrystallisation.

The development of sulphur contents appreciably differs between the coarse-grain annealing processes according to prior art and those according to the invention only for strip temperatures from above 900° C. Thus the advantageous effect of the variant according to the invention occurs also if the annealing atmosphere low in hydrogen is applied only at a later point of the heating phase. For example, should the application of annealing atmospheres very low in hydrogen (e.g. 5 vol % hydrogen) during the heating phase cause problems to the surface condition of the strip, due to its very high oxidation potential, then the process according to the invention can be altered as follows: annealing starts with an annealing atmosphere high in hydrogen. After attaining a strip temperature of at least 450° C. and at the most 750° C., alter the composition of the annealing gas and continue annealing in an atmosphere low in hydrogen. In principle it would be possible to make the change in annealing atmosphere once 900° C. has been reached, but it might be difficult, with a hood-type furnace used for such coarse-grain annealing—due to the high heat capacity of the charged coiled material and the resulting temperature gradients—to determine the strip temperature with adequate accuracy. Once the holding temperature of at least 1150° C. has been reached, again alter the gas atmosphere and heavily increase the hydrogen content, preferably to 100%. As far as its effect is concerned, this modification of the process according to the invention is identical to the process according to the invention described earlier above.

TABLE 1

| | Chemical composition of the test material in mass % | | | | | | |
|---|---|---|---|---|---|---|---|
| | C | Mn | S | Si | Cu | Al | N |
| Melt A: | 0.061% | 0.080% | 0.023% | 3.08% | 0.068% | 0.020% | 0.0079% |
| Melt B: | 0.048% | 0.089% | 0.024% | 3.20% | 0.077% | 0.022% | 0.0086% |
| Melt C: | 0.058% | 0.097% | 0.022% | 3.21% | 0.070% | 0.021% | 0.0073% |
| Melt D: | 0.057% | 0.081% | 0.027% | 3.12% | 0.078% | 0.022% | 0.0074% |
| Melt E: | 0.085% | 0.081% | 0.023% | 3.20% | 0.071% | 0.023% | 0.0085% |

TABLE 2

| Magnetic properties of the strips demonstrated in the examples, following different coarse-grain annealing processes | | | | | | |
|---|---|---|---|---|---|---|
| | Type of coarse-grain annealing | | | | | |
| | "Reference" | | "New" | | "Inert" | |
| Melt | J800 in T | P 1.7 in W/kg | J800 in T | P 1.7 in W/kg | J800 in T | P 1.7 in W/kg |
| A | 1.91 | 1.11 | 1.94 | 0.91 | 1.93 | 1.00 |
| B | 1.94 | 1.03 | 1.93 | 0.95 | 1.92 | 1.04 |
| C | 1.92 | 1.06 | 1.94 | 0.91 | 1.93 | 1.01 |
| D | 1.89 | 1.15 | 1.93 | 0.95 | 1.93 | 0.99 |
| E | 1.91 | 1.09 | 1.94 | 0.92 | 1.93 | 1.03 |
| Average value | 1.912 | 1.09 | 1.936 | 0.93 | 1.925 | 1.01 |

What is claimed is:

1. A process for producing grain-oriented magnetic steel sheeting in which a slab made from a steel containing (in mass %)

more than 0.005 to 0.10% C, 2.5 to 4.5% Si, 0.03 to 0.15% Mn, more than 0.01 to 0.05% S, 0.01 to 0.035% Al, 0.045 to 0.012% N, 0.02 to 0.3% Cu, the remainder being Fe, including unavoidable impurities is heated through a temperature below the solubility temperature for manganese sulphide, at any rate however below 1320° C. but above the solubility temperature for copper sulphides; subsequently hot rolled to a final thickness of the hot strip between 1.5 and 7.0 mm, with an initial temperature of at least 960° C. and with a final temperature in the range of 880 to 1000° C.; the hot strip is subsequently annealed for 100 to 600 s at a temperature ranging from 880 to 1150° C. and immediately cooled at a cooling rate in excess of 15 K/s and cold rolled in one or several cold-rolling steps to the final thickness of the cold strip; subsequently the cold strip is subjected to a recrystallizing annealing process in a humid atmosphere containing hydrogen and nitrogen, with synchronous decarburisation, and after applying on both sides a parting agent, essentially containing MgO, it is annealed at high temperature and after applying an insulating layer, it is subjected to final annealing, characterized in that the cold strip—for said high-temperature annealing—is heated in an atmosphere comprising less than 25 vol. % $H_2$, the remainder being nitrogen and/or a noble gas, at least until the holding temperature of 1150 to 1200° C. is reached.

2. A process according to claim 1, wherein said high temperature annealing is characterized in that after reaching the holding temperature, the $H_2$ content of the annealing is gradually increased to up to 100%.

3. A process according to claim 1, wherein said high temperature annealing is characterized in that the annealing gas atmosphere until it reaches a temperature ranging from 450 to 750° C. contains more that 50 vol. % $H_2$; that after exceeding this temperature the $H_2$ content is lowered to below 25 vol. % and after reaching the holding temperature the $H_2$ content is increased to up to 100%.

4. The process according to claim 1, wherein said noble gas is argon.

5. The process according to claim 1, wherein said holding temperature is approximately 1180° C.

* * * * *